US012742365B2

(12) United States Patent
Dawm

(10) Patent No.: US 12,742,365 B2
(45) Date of Patent: Sep. 22, 2026

(54) WELL MENDER

(71) Applicant: Adel Yahya Dawm, Al Khobar (SA)

(72) Inventor: Adel Yahya Dawm, Al Khobar (SA)

( * ) Notice: Subject to any disclaimer, the term of this patent is extended or adjusted under 35 U.S.C. 154(b) by 0 days.

(21) Appl. No.: 18/812,146

(22) Filed: Aug. 22, 2024

(65) Prior Publication Data

US 2025/0188813 A1 Jun. 12, 2025

(30) Foreign Application Priority Data

Dec. 10, 2023 (SA) ..... 123451006

(51) Int. Cl.
*E21B 37/00* (2006.01)
*E21B 34/06* (2006.01)

(52) U.S. Cl.
CPC ..... *E21B 34/063* (2013.01); *E21B 37/00* (2013.01)

(58) Field of Classification Search
CPC ..... E21B 34/063; E21B 37/00
See application file for complete search history.

(56) References Cited

U.S. PATENT DOCUMENTS 2,897,897 A * 8/1959 Breukelman ..... E21B 49/08 166/134
6,250,387 B1 * 6/2001 Carmichael ..... E21B 21/002 166/229
6,607,031 B2 * 8/2003 Lynde ..... E21B 27/005 166/99
7,040,395 B2 * 5/2006 Booth ..... E21B 37/02 166/173
7,513,303 B2 * 4/2009 Hern ..... E21B 37/00 166/99
9,624,750 B2 * 4/2017 Entchev ..... E21B 33/12
10,053,961 B2 * 8/2018 Wilson ..... E21B 37/00
10,138,709 B2 * 11/2018 Shaffer ..... E21B 43/116
10,190,397 B2 * 1/2019 Budde ..... E21B 43/10
10,590,735 B2 * 3/2020 Linklater ..... E21B 43/08
11,851,987 B2 * 12/2023 Zimmerman, Sr. ..... E21B 34/14
11,933,139 B1 * 3/2024 Al-Mousa ..... E21B 33/14
12,264,553 B2 * 4/2025 Dyck ..... E21B 34/063
2010/0243258 A1 * 9/2010 Fishbeck ..... E21B 31/06 166/105.1
2013/0168091 A1 * 7/2013 Xu ..... E21B 31/08 166/99
2014/0374111 A1 * 12/2014 Xu ..... E21B 37/00 166/99

* cited by examiner

*Primary Examiner* — Aaron L Lembo
(74) *Attorney, Agent, or Firm* — Sughrue Mion, PLLC

(57) ABSTRACT

A WELL MENDER A well mender, for performing RIH and POOH, comprising: a diverter cup equipped with a rubber element configured to direct fluid flow and serve as a seal interface between a casing and said tool body; a filter sleeve with predetermined hole sizes for filtering out debris of specified sizes; a valve housing providing a controlled pathway for drilling fluid and debris; a valve configured for targeted flow control and debris management; a shut off ball configured to block fluid flow at desired stages of operation; a lower filter sleeve positioned below said filter sleeve for additional debris capture; one or more lower diverter channels to facilitate controlled flow and direction of fluids and debris; an internal lock key for securing and stabilizing said well mender within a well bore; and a rupture disk configured to rupture upon a predetermined differential pressure, providing an emergency pressure release mechanism.

25 Claims, 14 Drawing Sheets

WELL MENDER

FIELD OF THE INVENTION

Embodiments of the present invention generally relate to multi-component tools designed for optimized debris management, fluid flow control, and safety during well bore operations. Particularly, the present disclosure relates to a well mender for performing run in hole (RIH) and pull out of the hole (POOH).

BACKGROUND OF THE INVENTION

The exploration and extraction of water, hydrocarbons etc from beneath the Earth's surface necessitates the drilling of well bores. During drilling operations, debris and junk, which can include metal fragments, bits of rubber, and other residual materials, are often generated or introduced into the well. The presence of these unwanted elements can hinder well operations, reduce the efficiency of extraction, and ultimately compromise the overall productivity of the well.

Traditional debris and junk collection systems primarily rely on methods that either target large debris during the "run in hole" (RIH) phase or collect the debris during the "pull out of the hole" (POOH) phase. Both of these methods have significant limitations. The first method often leaves smaller particles behind, as they can bypass conventional tools, leading to accumulation at the bottom of the well bore. This accumulation can lead to blockages and impede subsequent well operations. On the other hand, the second method struggles with the larger debris that cannot be bypassed and hence remains within the well, posing risks for the completion process.

Additionally, the traditional debris management tools are cumbersome and are not designed for easy disassembly on the rig floor. This makes the junk recovery process tedious and time-consuming, and often requires specialized equipment and manpower. Furthermore, the inability to quickly and efficiently manage debris can result in prolonged downtimes, escalating operational costs, and potential safety hazards.

The traditional system operates in a standard manner, offering limited capabilities and lacking assurance that the well is adequately cleaned or primed for completion and production. This system often necessitates multiple attempts to cleanse, especially challenging in horizontal wells where small particles tend to settle on the lower side and cannot be easily circulated out. Additionally, it lacks a sealing device to channel drilling fluid into the filter sleeve during extraction and does not incorporate an emergency rupture disk to prevent well swabbing.

Therefore, accordingly, there remains a need in the art for a well bore clean-out apparatus that can overcome the aforementioned problems and also integrates enhanced features such as optimal debris management, efficient fluid flow control, safety mechanisms, and adaptability to both drilling and non-drilling assemblies to boost overall efficiency and safety of well bore operations.

OBJECT OF THE INVENTION

An object of the present invention is to provide a multi-component tool that facilitates efficient debris management, controlled fluid flow, and ensures safety during well bore operations.

Another object of the present invention is to offer an apparatus specifically designed for both running into the hole (RIH) and pulling out of the hole (POOH), enhancing the adaptability and versatility of well bore cleaning and maintenance tasks.

Yet another object of the present invention is to introduce an apparatus that streamlines well bore operations by integrating various components like filter sleeves, diverter cups, and valve housings to manage debris and fluids systematically.

Yet another object of the present invention is to incorporate safety features, such as the rupture disk, to prevent potential damages due to unexpected pressure build-ups and ensure smooth operational continuity.

Yet another object of the present invention is to offer an apparatus that may be easily disassembled on-site, promoting rapid junk recovery and tool maintenance without the need for specialized equipment.

Yet another object of the present invention is to design a tool that combines both drilling and non-drilling assemblies, maximizing its utility across different well bore operations.

Yet another object of the present invention is to ensure a leak-proof operation through elements like the diverter cup's rubber, preventing fluid bypass during various operational stages.

Yet another object of the present invention is to enhance the quality of the filtered output by efficiently trapping debris exceeding predetermined sizes, ensuring the well's suitability for production.

SUMMARY OF THE INVENTION

According to an aspect of the present invention, there is provided a well mender, a multi-function tool configured for optimizing cleaning and recovery operations within a well bore, for performing run in hole (RIH) and pull out of the hole (POOH), wherein the well mender comprising: a diverter cup equipped with a rubber element configured to direct fluid flow and serve as a seal interface between a casing and said tool body; a filter sleeve with predetermined hole sizes for filtering out debris of specified sizes; a valve housing providing a controlled pathway for drilling fluid and debris; a valve configured for targeted flow control and debris management; a shut off ball configured to block fluid flow at desired stages of operation; a lower filter sleeve positioned below said filter sleeve for additional debris capture; one or more lower diverter channels to facilitate controlled flow and direction of fluids and debris; an internal lock key for securing and stabilizing said well mender within a well bore; and a rupture disk configured to rupture upon a predetermined differential pressure, providing an emergency pressure release mechanism.

In accordance with an embodiment of the present invention, the well mender comprises means for facilitating on-site disassembly for junk recovery, inspection, and tool maintenance.

In accordance with an embodiment of the present invention, the multi-function tool being run into the well (referred to as "run in hole"), configured to recover (or collect) large debris as well as pieces of rubber using a junk collector.

In accordance with an embodiment of the present invention, the multi-function tool being a filter in a downhole environment, configured to capture and filter out unwanted debris from the well fluids as the tool is being removed from the wellbore.

In accordance with an embodiment of the present invention, the diverter cup is configured to divert fluid while pull out of the hole (POOH) into the filter sleeve to make sure no debris left in the hole before running completion.

In accordance with an embodiment of the present invention, the well mender comprises a float ball valve working in both direction while run in hole (RIH), allowing small particles flow upward and pull out of the hole to close bypass trap debris inside.

In accordance with an embodiment of the present invention, the well mender comprises a lower junk basket configured to swallow large size of junk while run in hole (RIH) allow high flow rate.

In accordance with an embodiment of the present invention, the well mender comprises a long filter sleeve to collect small particles larger 1 MM to be trapped inside.

In accordance with an embodiment of the present invention, the well mender comprises a Ball seat (114) and flow bath, the run-in hole (RIH), the Ball seat is configured to let the drilling fluid move upward through this flow bath or pathway. Further, during pull out of hole (POOH), a ball of the Ball seat is adapted to position in the Ball seat and shut off or block the flow bath thereby trapping the debris inside.

In accordance with an embodiment of the present invention, the multi-function tool is adapted to be integrated as a part of both drilling and non-drilling assemblies, enhancing the versatility of the tool for varied well bore operations.

In accordance with an embodiment of the present invention, the diverter cup's rubber element further ensures a leak-proof seal, preventing fluid bypass around the tool during operational stages.

In accordance with an embodiment of the present invention, the filter sleeve may be configured to validate the well's suitability for production by trapping debris exceeding a predetermined size.

In accordance with an embodiment of the present invention, the valve provides unique flow control capabilities, enhancing the tool's debris management efficiency.

In accordance with an embodiment of the present invention, the shut off ball is adapted to engage or disengage based on operational needs, providing flexibility in fluid management within the well bore.

In accordance with an embodiment of the present invention, the lower filter sleeve offers an additional layer of filtration, ensuring maximum debris capture during well bore cleaning operations.

In accordance with an embodiment of the present invention, the one or more lower diverter channels aid in the systematic and controlled redirection of fluids and debris, ensuring optimal cleaning efficiency.

In accordance with an embodiment of the present invention, the lower lock key provides a secure fit of the tool within the well bore, minimizing tool movement during operations.

In accordance with an embodiment of the present invention, the rupture disk serves as a safety feature, preventing potential damages due to unexpected pressure build-ups by providing a controlled release mechanism.

In accordance with an embodiment of the present invention, the rupture disk is specifically calibrated to rupture upon experiencing a differential pressure of 90 to 110 psi, ensuring a prompt response to pressure fluctuations.

In accordance with an embodiment of the present invention, the valve housing includes a main mandril designed as a single piece, featuring a 4½ in box connection with an integral groove, optimizing the connection strength and integrity.

In accordance with an embodiment of the present invention, the filter sleeve comprises hole sizes of 3 MM, ensuring debris exceeding this size is efficiently trapped, enhancing the quality of the filtered output.

In accordance with an embodiment of the present invention, the diverter cup's rubber element is tailored to fit securely within the casing internal diameter (ID), further enhancing its sealing efficiency and fluid diversion capabilities while POOH.

In accordance with an embodiment of the present invention, the shut off ball, when engaged, offers a complete blockage of fluid flow, allowing for stages of operation where fluid movement is undesired.

In accordance with an embodiment of the present invention, the multi-function tool's design incorporates features facilitating easy on-site disassembly, enabling rapid junk recovery and tool maintenance without the need for specialized equipment.

In accordance with an embodiment of the present invention, the casing refers to the tubular steel structure that is placed in a drilled well to stabilize the wellbore and prevent the surrounding rock formation from collapsing.

BRIEF DESCRIPTION OF THE DRAWINGS

So that the manner in which the above recited features of the present invention can be understood in detail, a more particular to the description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, the invention may admit to other equally effective embodiments. These and other features, benefits and advantages of the present invention will become apparent by reference to the following text figure, with like reference numbers referring to like structures across the views, wherein.

DETAILED DESCRIPTION OF THE DRAWINGS

Figure 1:
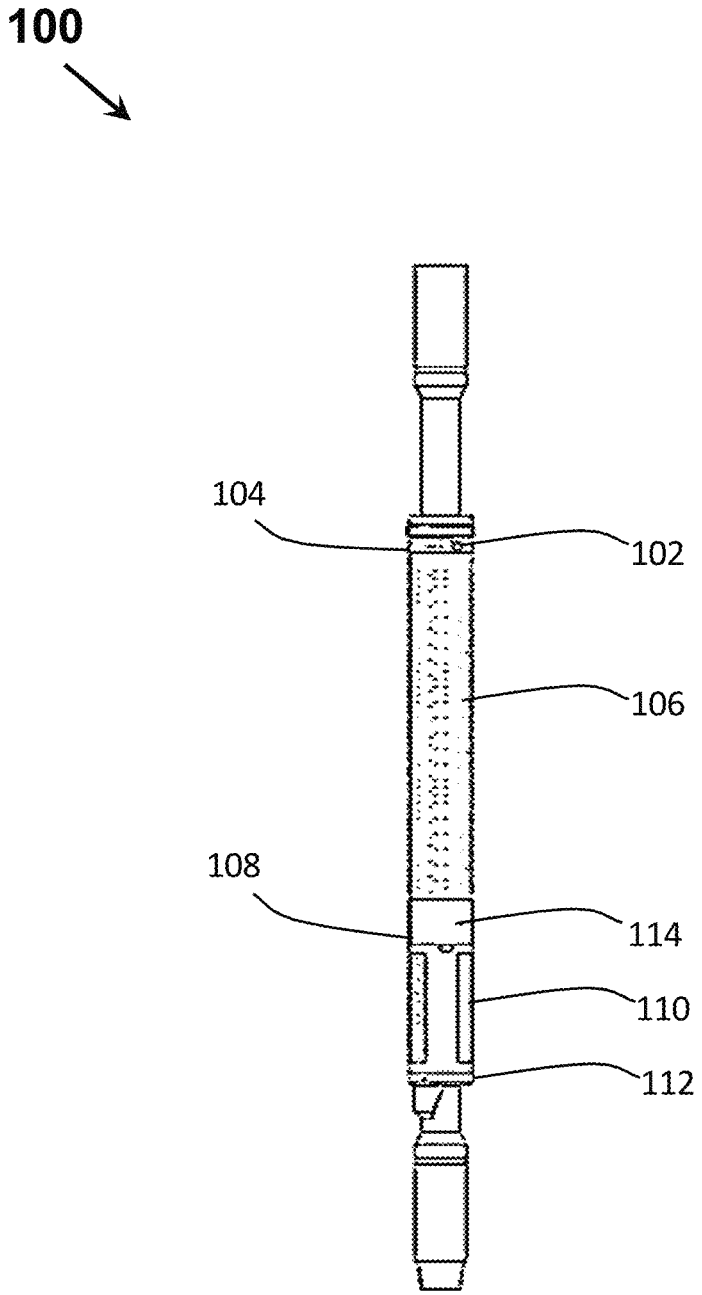
FIG. 1 illustrates a well mender, for performing RIH and POOH, in accordance with an embodiment of the present invention.

The present invention is described hereinafter by various embodiments with reference to the accompanying drawing, wherein reference numerals used in the accompanying drawing correspond to the like elements throughout the description.

While the present invention is described herein by way of example using embodiments and illustrative drawings, those skilled in the art will recognize that the invention is not limited to the embodiments of drawing or drawings described and are not intended to represent the scale of the various components. Further, some components that may form a part of the invention may not be illustrated in certain figures, for case of illustration, and such omissions do not limit the embodiments outlined in any way. It should be understood that the drawings and detailed description thereto are not intended to limit the invention to the particular form disclosed, but on the contrary, the invention is to cover all modifications, equivalents, and alternatives falling within the scope of the present invention as defined by the appended claims. As used throughout this description, the word "may" is used in a permissive sense (i.e., meaning having the potential to), rather than the mandatory sense, (i.e., meaning must). Further, the words "a" or "an" mean "at least one" and the word "plurality" means "one or more" unless otherwise mentioned. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes. Any discussion of documents, acts, materials, devices, articles and the like is included in the specification solely for the purpose of providing a context for the present invention. It is not suggested or represented that any or all of these matters form part of the prior art base or were common general knowledge in the field relevant to the present invention.

This invention may, however, be embodied in many different forms and should not be construed as limited to the embodiment set forth herein. Rather, the embodiment is provided so that this disclosure will be thorough and complete and will fully convey the scope of the invention to those skilled in the art. In the following detailed description, numeric values and ranges are provided for various aspects of the implementations described. These values and ranges are to be treated as examples only and are not intended to limit the scope of the claims. In addition, a number of materials are identified as suitable for various facets of the implementations. These materials are to be treated as exemplary and are not intended to limit the scope of the invention.

The present invention aims to save rig time by streamlining method adapted during both run-in-hole and pull-out-of-hole operations. The well mender is configured to efficiently filters out debris from drilling fluids, ensuring the well's cleanliness. By optimizing the number of runs and reducing risks, it addresses challenges faced with traditional systems, especially in horizontal wells where debris settling is a concern. The well mender in the present invention is adaptive, catering to both drilling and non-drilling applications, making it a versatile solution for well maintenance and preparation for production.

FIG. 1 illustrates a well mender (100), in accordance with an embodiment of the present invention. As shown in FIG. 1, the well mender (100) comprises a rupture disk (102), a lock key (112), a lower filter sleeve (110), a ball seat (114), a diverter cup (104), a filter sleeve (106), valve housing (108) and a shut off ball. At the apex of the tool is the rupture disk (102).

Figure 2:
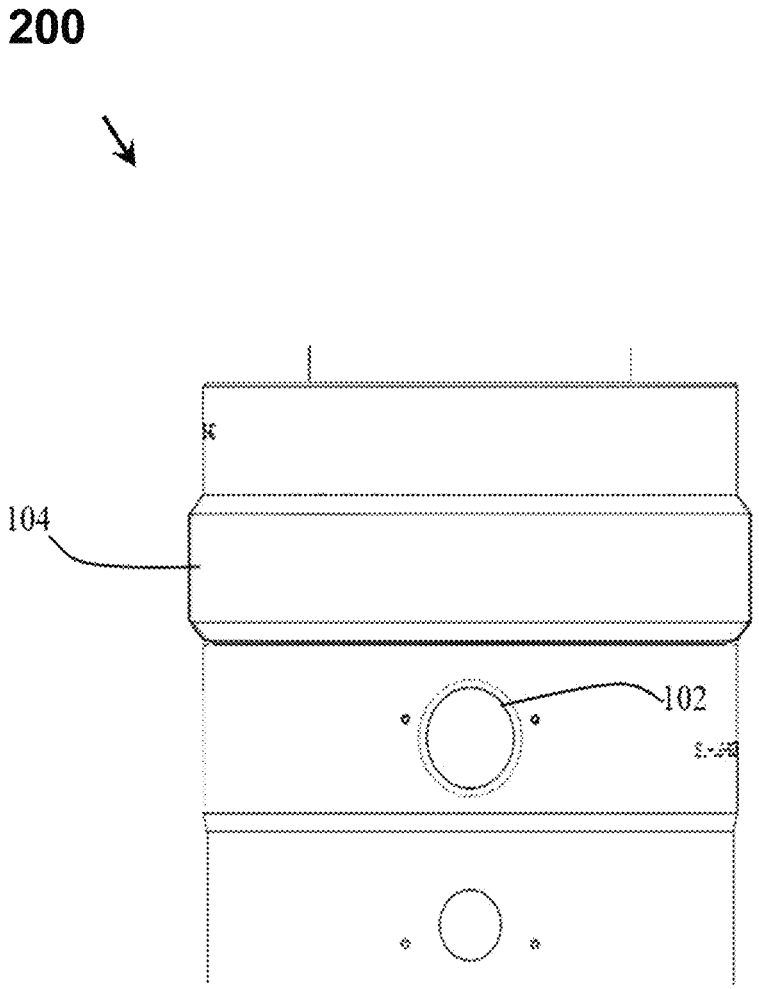
FIG. 2 illustrates diverter cup and rupture disk, in accordance with an embodiment of the present invention.

FIG. 2 illustrates diverter cup and rupture disk, in accordance with an embodiment of the present invention. A rupture disk (102), also known as a burst disk or bursting disc, is a pressure safety device used to protect a system from over pressurization or potentially damaging vacuum conditions. It may be a one-time-use membrane made of metal or a composite material, designed to burst or rupture when a predetermined differential pressure (either positive or negative) across the disk is exceeded.

The rupture disk (102) is configured to act as a fail-safe. In case the system (100) pressure exceeds or falls below safe levels, the disk ruptures to release or let in gases or liquids, thereby preventing potential damage or failure of the system. It may be especially important in industrial systems where an overpressure or vacuum situation may lead to catastrophic events.

The rupture disks (102) are often installed in tandem with pressure relief valves, providing a sealing function to prevent leaks while the valve is inactive. If the rupture disk (102) bursts, it signals that an overpressure event occurred, and the system may then be checked and reset with a new rupture disk (102). When a predefined differential pressure is encountered, usually around 90 to 110 psi, it ruptures to equalize the internal pressure, preventing damage to the tool or the well. Below this, as shown in FIG. 2, the diverter cup (104) is a crucial component predominantly used in the oil and gas industry's downhole tools and operations. Its primary role is to guide or redirect the flow of fluids, such as drilling mud or other fluids, either to guide them in a specific direction or to establish a seal between components. Configured with a concave or cup-like structure, the diverter cup (104) excels in channeling or redirecting fluids effectively. Typically made from flexible and enduring materials like rubber, silicone, polyurethane, or neoprene, the diverter cup (104) ensures a tight seal while also resisting the abrasive and corrosive nature of some drilling fluids. In many applications, it functions as a sealing mechanism between the tool and the casing or tubing, thus preventing any unwanted fluid bypass. The sealing mechanism may guarantee that the fluid flows in the desired path and helps in maintaining pressure within the system. Moreover, it may play a pivotal role in steering the drilling fluid or other materials away from certain regions or towards designated sections of the tool or wellbore. Additionally, the diverter cup (104) may offer protection to other components by directing debris or excess fluid away from sensitive areas, ensuring the safety and efficiency of downhole operations. Adjacent to the diverter cup (104), the filter sleeve (106) makes its appearance. The lock key (112) as shown in FIG. 1 may play an essential role in anchoring or connecting the tool during its various operations. All these components, when integrated, provide an efficient system for wellbore cleaning and debris management. The material for the lock key (112) may be selected from, but not limited to, stainless steel, bronze, aluminum, or brass, is situated at the tool's base.

Figure 3A:
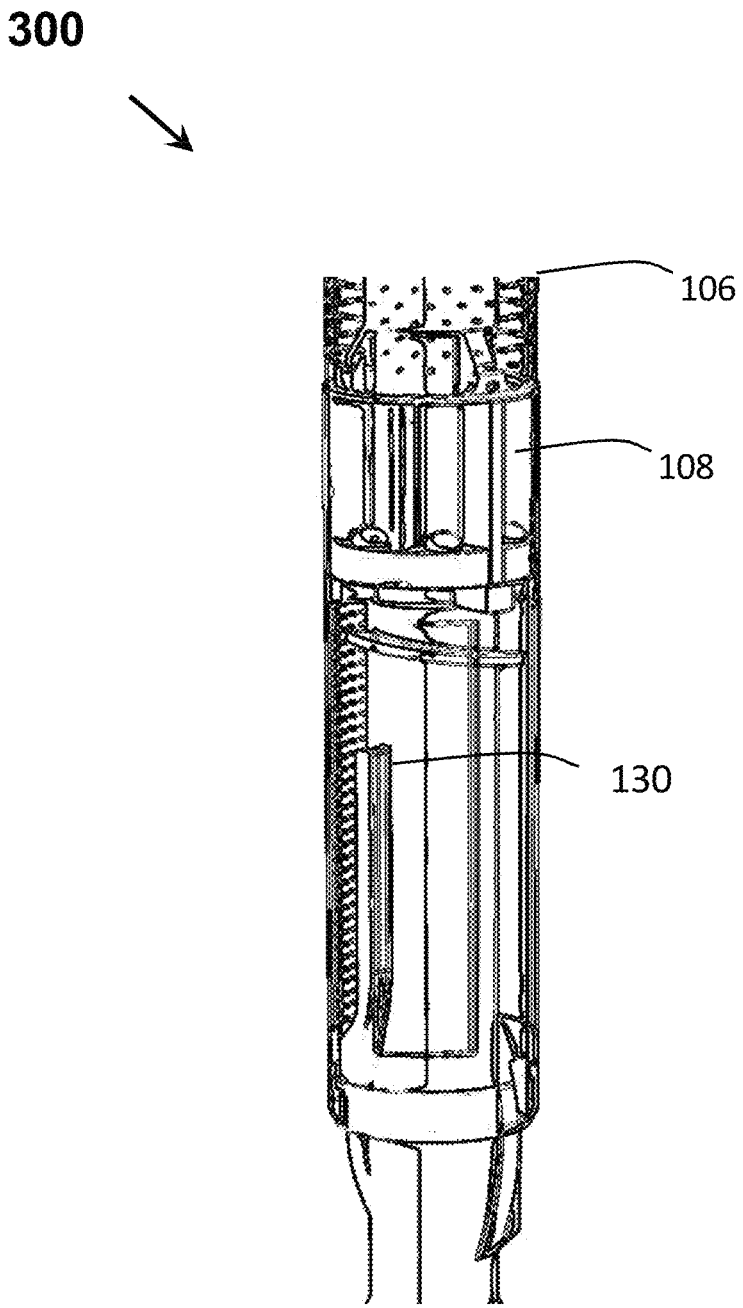
FIG. 3A illustrates a filter sleeve with a junk collector, in accordance with an embodiment of the present invention.
Figure 3B:
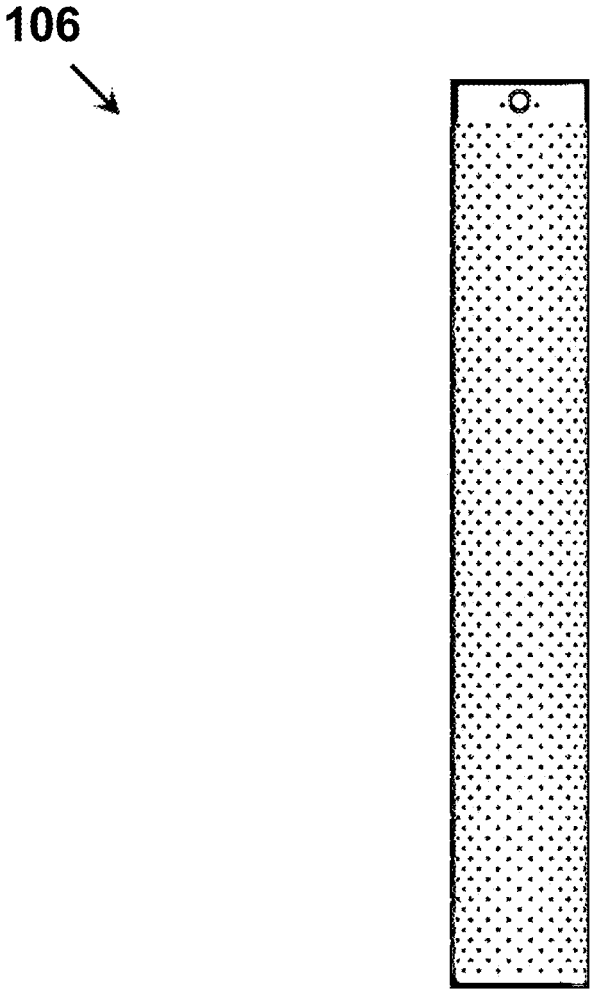
FIG. 3B illustrates a filter sleeve, in accordance with an embodiment of the present invention.

FIG. 3A illustrates a filter sleeve with a junk collector, in accordance with an embodiment of the present invention. As shown in the embodiment (300) in FIG. 3A, the cylindrical subsection of the well mender (100) at the top filter sleeve (106) is there connected with the valve housing (108), it may control the flow or release of substances within the well mender (100). It configured to permit fluid flow while entrapping larger debris particles, contributing significantly to the cleanliness of the well. At the bottom as shown in the figure is a junk collector (130). Crafted from materials like stainless steel mesh, polyester, nylon, or polypropylene, the filter sleeve may perforate. The filter sleeve (106) may be further illustrated using FIG. 3B. It depicts a perforated or dotted pattern on a cylindrical surface.

Figure 4A:
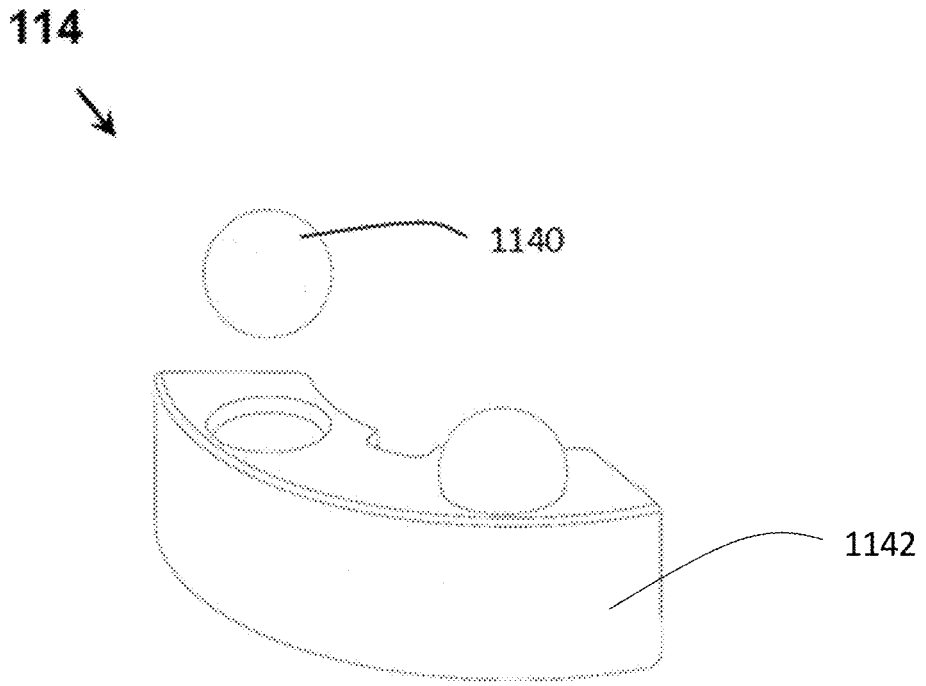
FIG. 4A illustrates a ball with a ball seat, in accordance with the present invention.
Figure 4B:
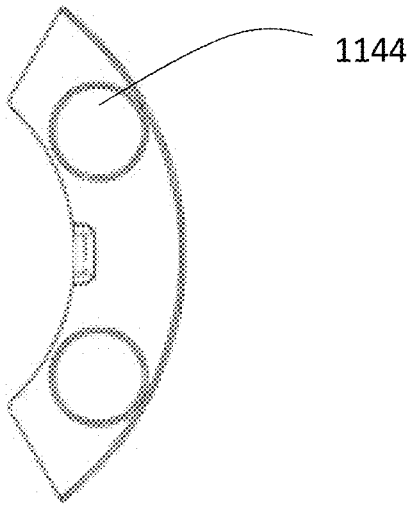
FIG. 4B illustrates a top view of the ball seat, in accordance with the present invention.
Figure 4C:
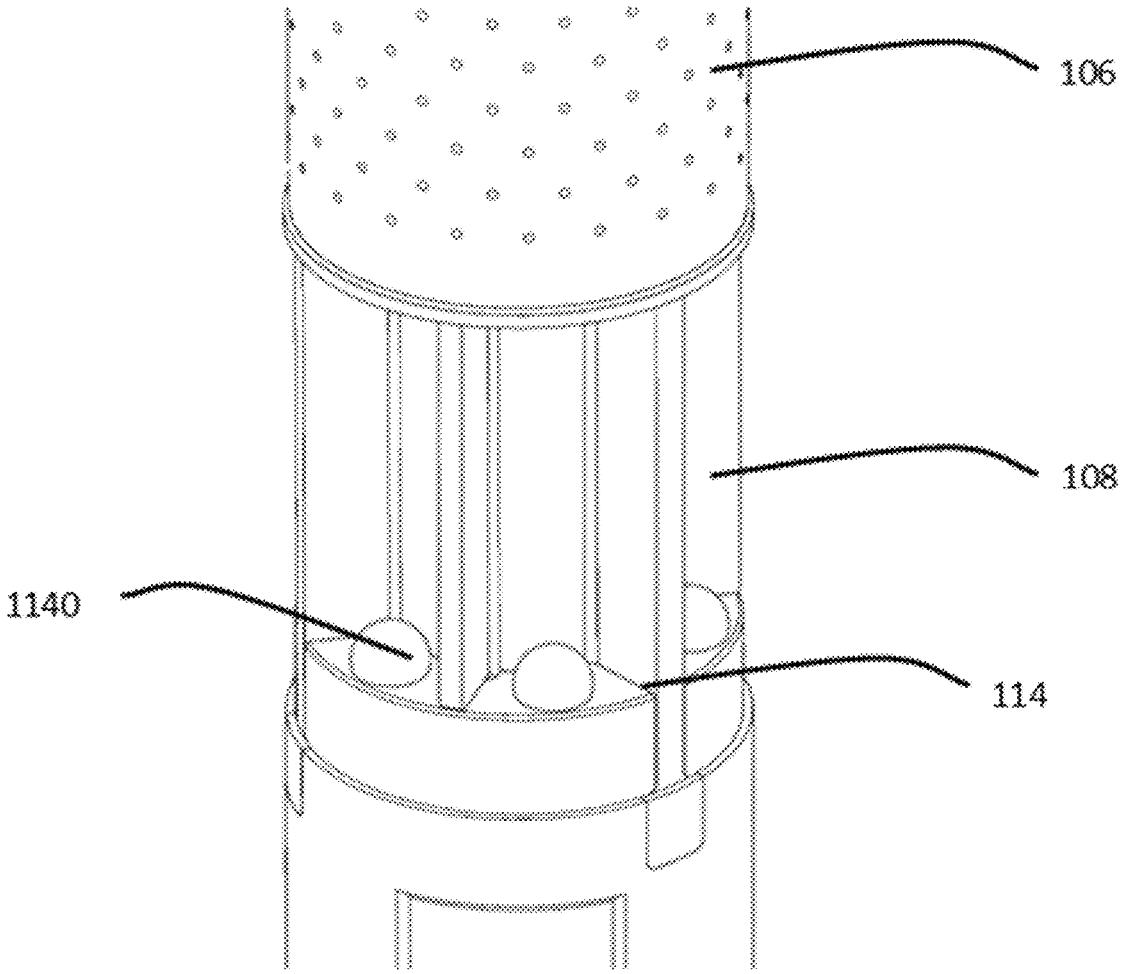
FIG. 4C illustrates a ball housing with ball seat and filter sleeve, in accordance with the present invention.

Further down, the Ball seat (114) is positioned. FIG. 4A-4C illustrates a Ball seat (114) and flow bath, in accordance with the present invention. Using materials such as hardened steel, bronze, ceramic, or PTFE, it has a twofold role. The FIG. 4B illustrates the top view of the ball (1140) with the flow path (1144). In the run-in-hole phase, it facilitates fluid flow. Conversely, during the pull-out operation, a ball (1140) may settle on the ball seat (114) as shown in FIG. 4A-4B. The action may shuts off the flow, ensuring debris remains confined within the tool. Directly beneath the filter sleeve (106) and the Ball seat (114) is the valve housing (108) and shut off ball (1140) as shown in the FIG. 4C. It may include materials like brass, stainless steel, Teflon, or PVC, the section shelters the mechanism for a unique one-way valve. The shut-off ball (1140), in tandem with the Ball seat (114), ensures debris retention during operations. In accordance with an embodiment of the present invention, the valve housing (108) includes a main mandril.

Figure 5:
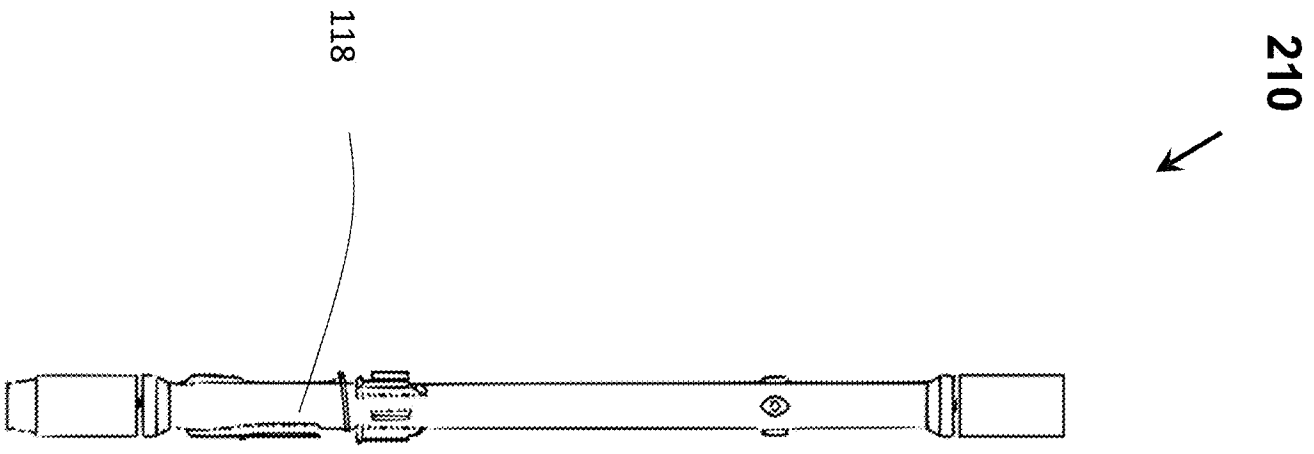
FIG. 5 illustrates a main mandril, in accordance with the present invention.

FIG. 5 illustrates a main mandril, in accordance with the present invention. As shown in the figure, the embodiment of the well mender (100) depicts the main mandril (210) with one or more lower diverter channels (118) may be configured as a single piece, featuring a 4½ in box connection with an integral groove, optimizing the connection strength and integrity. However, the well mender (100) is adapted to be integrated as a part of both drilling and non-drilling assemblies, enhancing the versatility of the tool for varied well bore operations.

Positioned toward the tool's lower segment is the lower filter sleeve (110) debris basket. Made from materials like steel mesh, polyethylene, rubber, or metal alloy, it's configured to capture and confine larger debris entities, amplifying the tool's efficiency in cleaning.

Figure 6:
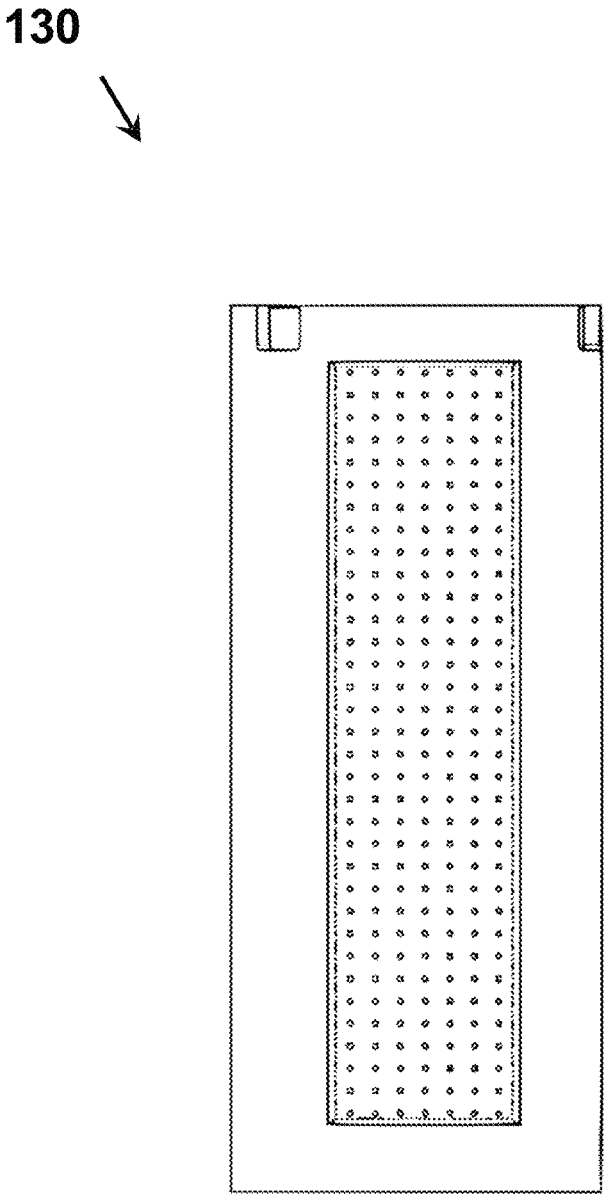
FIG. 6 illustrates a junk collector, in accordance with the present invention.
Figure 7:
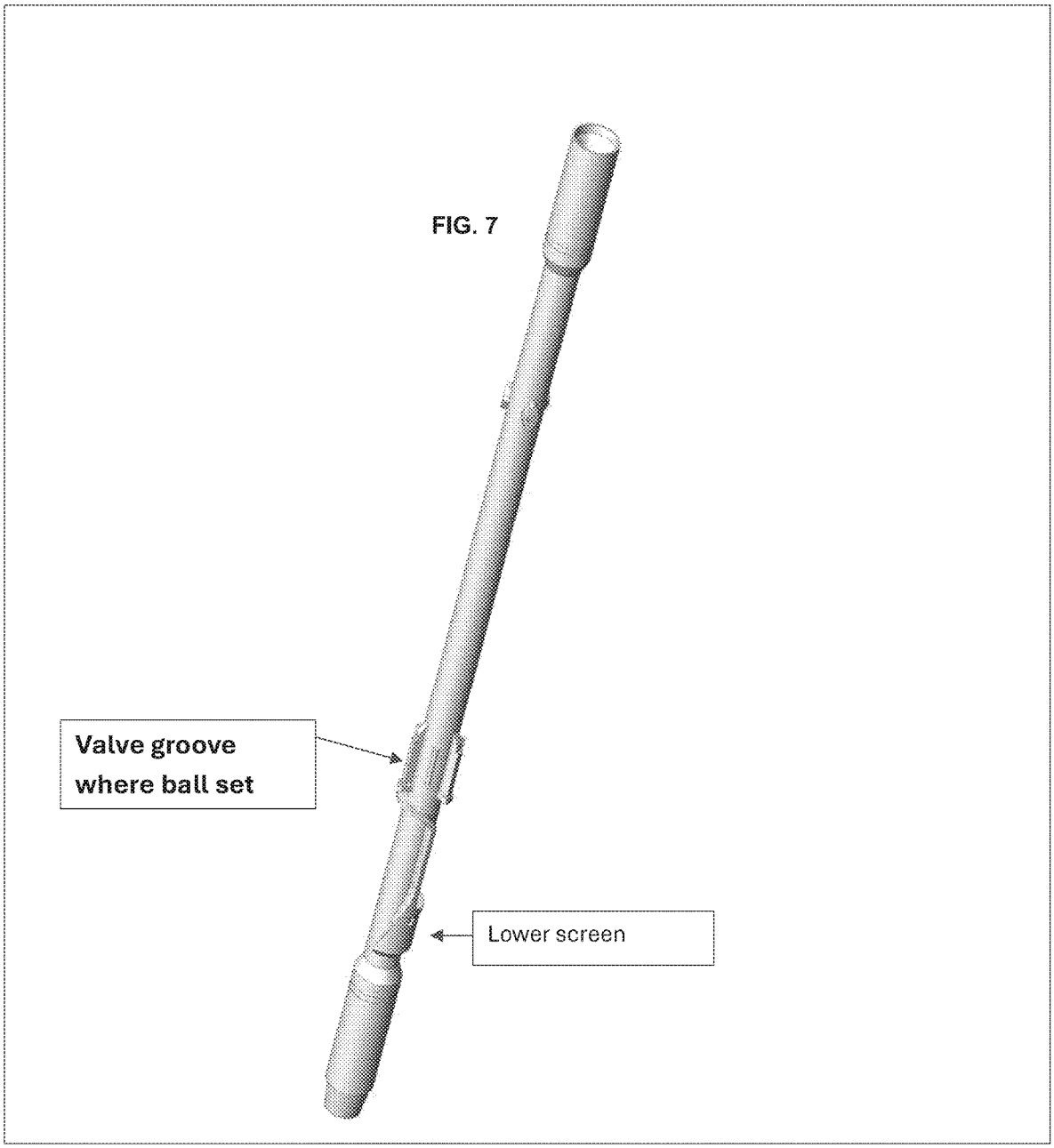
FIG. 7 illustrates a mandril comprising a lower screen, a diverter cup, and a valve groove according to one or more example embodiments.
Figure 8:
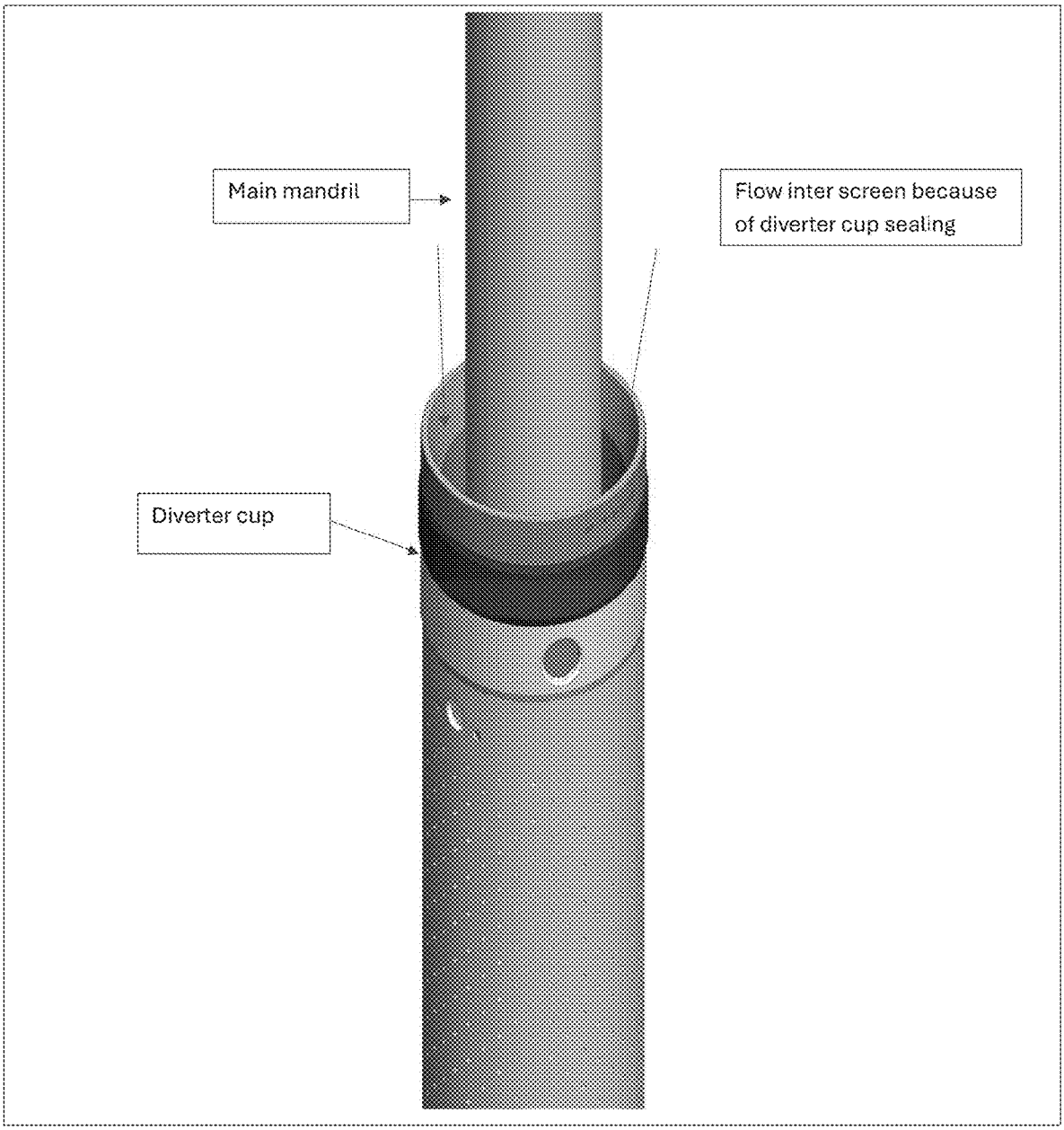
FIG. 8 illustrates an enlarged view of a portion of a mandril according to one or more example embodiments.
Figure 9:
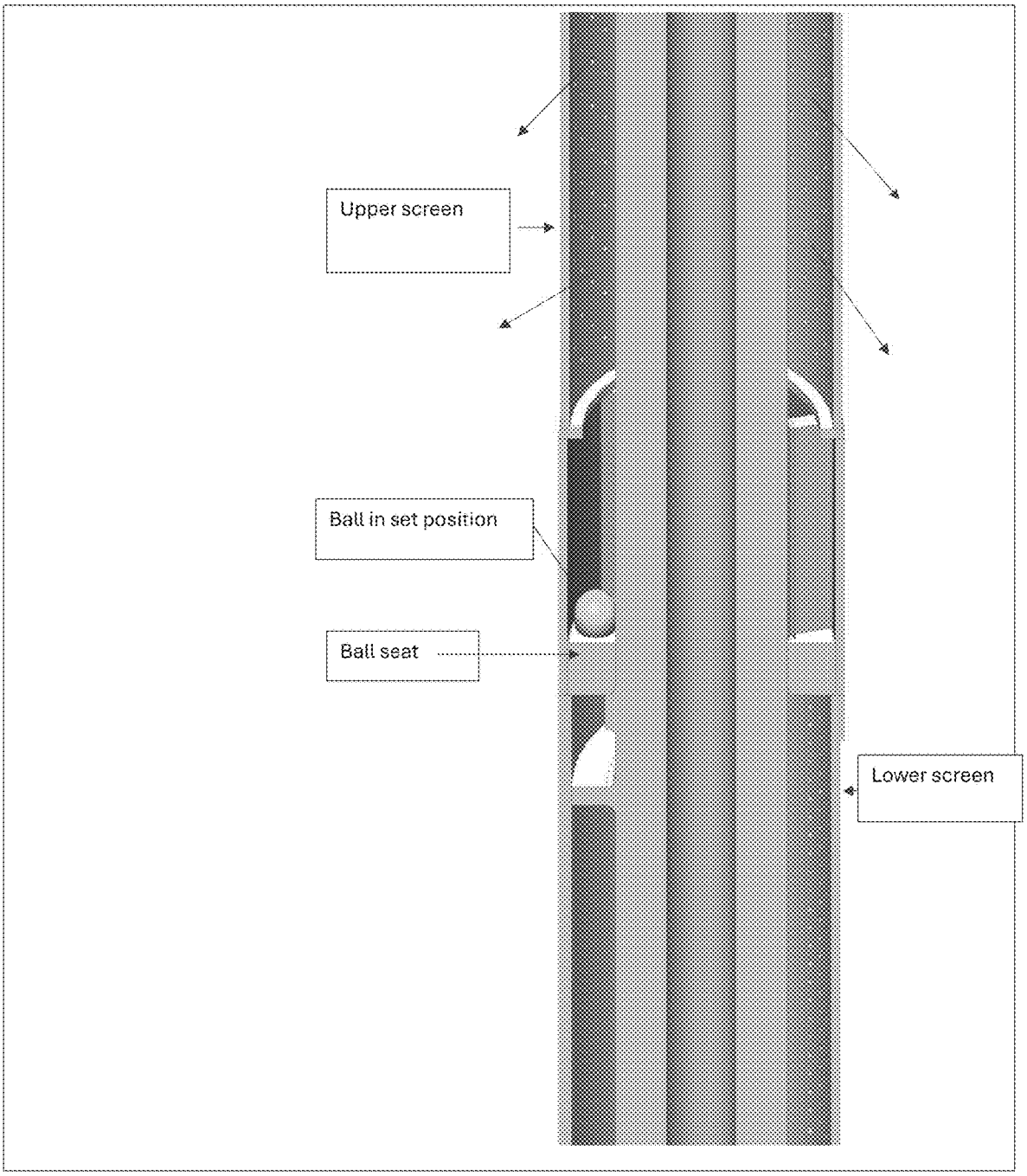
FIG. 9 illustrates an enlarged cross-sectional view of a portion of a mandril according to one or more example embodiments.
Figure 10:
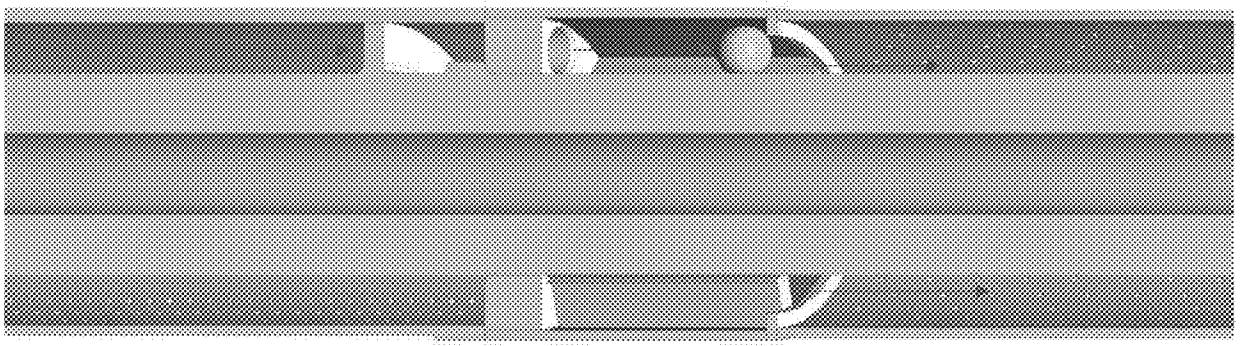
FIG. 10 illustrates another enlarged cross-sectional view of a portion of a mandril according to one or more example embodiments.
Figure 11:
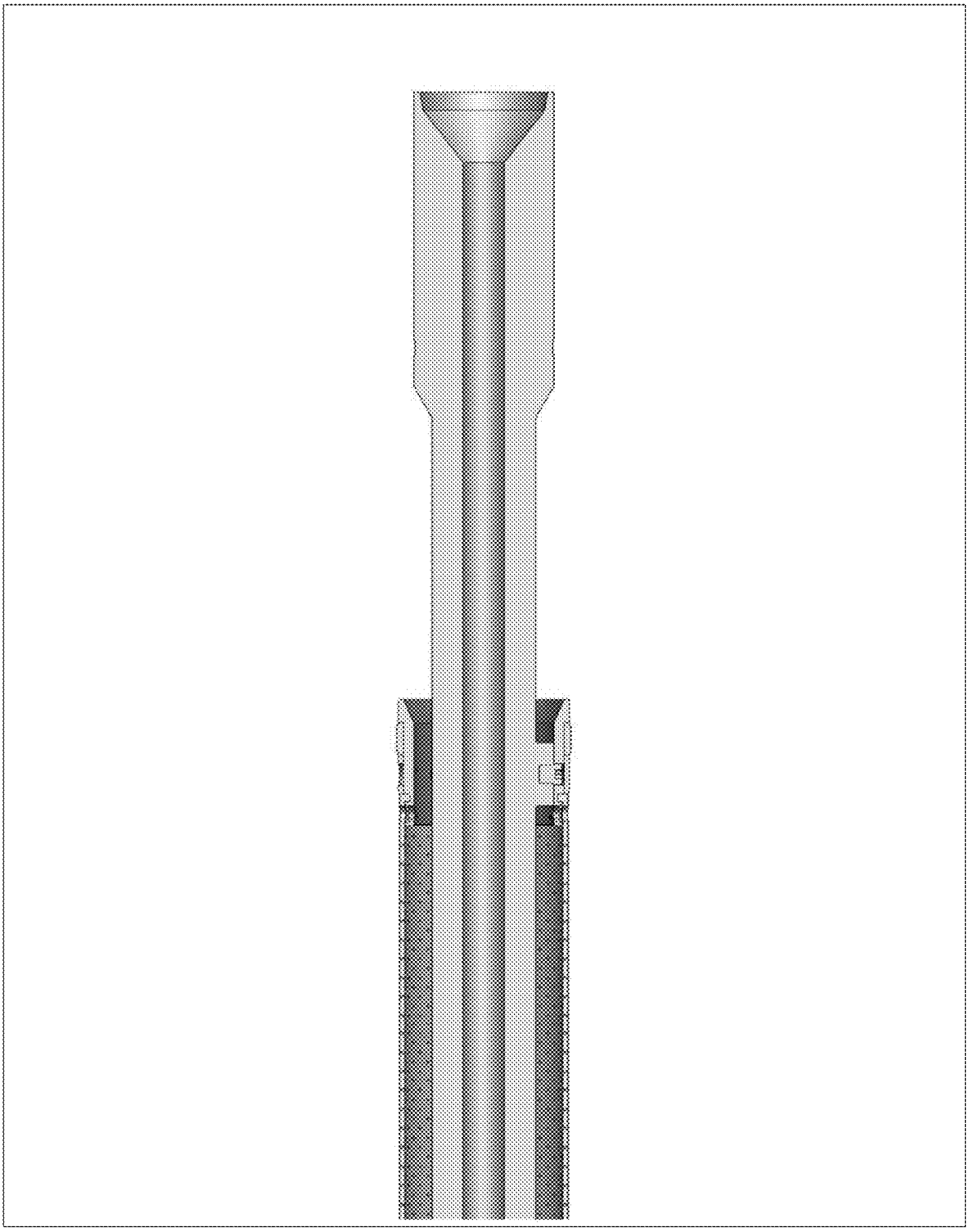
FIG. 11 illustrates an enlarged cross-sectional view of a top portion of a mandril according to one or more example embodiments.
Figure 12:
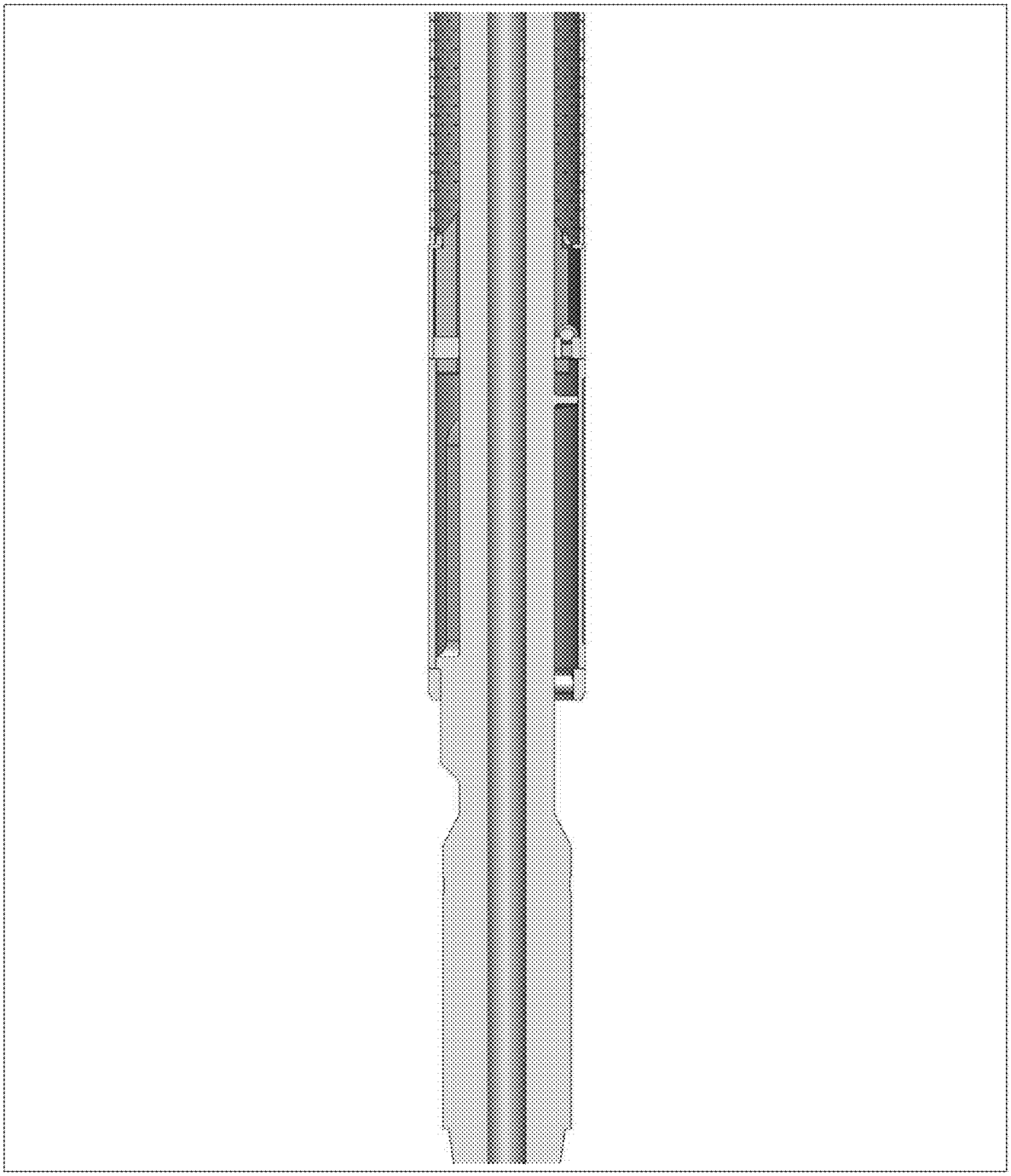
FIG. 12 illustrates an enlarged cross-sectional view of a bottom portion of a mandril according to one or more example embodiments.

FIG. 6 illustrates a junk collector, in accordance with the present invention. In the embodiment as shown in the FIG. 6, the junk collector or lower junk basket (130) in the context of oil and gas drilling and well completion refers to a downhole tool used to retrieve or collect unwanted debris from the wellbore. The debris may include fragments of metal, broken drill bits, pieces of casing, slips, or any other miscellaneous items that might inadvertently fall or break off into the wellbore during drilling or completion operations. The accumulation of such debris in the well may impede operations, damage equipment, or hinder production. Therefore, the junk collector (130) is often employed to ensure the wellbore remains clean and free from obstructions.

Furthermore, in accordance with an embodiment of the present invention, the well mender (100) comprises a float ball valve, a lower junk basket or junk collector (130) and a lower filter sleeve (110). The lower junk basket (130) is configured to collect large size of junk while the float ball valve to allow medium size to pass upward the long sleeve filter to filter fluid while pull of hole.

The invention works in following manner:

Initiation

The well mender (100) may be utilized to optimize cleaning and recovery operations within a well bore during both run in hole (RIH) and pull out of hole (POOH) operations.

Fluid Direction and Sealing

As the well mender (100) is run into the well (RIH), a diverter cup (104) with a specialized rubber element comes into play. This cup functions as both a guide and a seal. It directs the fluid flow and ensures a snug fit between the casing's internal diameter (the tubular steel structure stabilizing the well bore) and the tool body, providing a leak-proof seal and preventing unwanted fluid bypass. the diverter cup's (104) rubber element further ensures a leak-proof seal, preventing fluid bypass around the tool during operational stages. The multi-function tool being run into the well, configured to recover (or collect) large debris as well as pieces of rubber using the junk collector (130).

Debris Filtering

The fluid, along with any debris from the diverter cup (104) passes through the filter sleeve (106). This sleeve contains holes of specific sizes (which may be in range of, but not limited to, 1 MM to 10 MM and preferably, 3 MM and designed to trap any debris exceeding the predetermined size (of 1-10 MM), effectively filtering the well fluid. The lower filter sleeve (110), as shown in FIG. 1, is strategically positioned below the primary filter sleeve (106), offering a second layer of filtration for enhanced debris capture. If there's a need for extended filtration, a long filter sleeve (106) may be utilized, capturing even tiny particles larger than 1 MM. The lower filter sleeve (110) offers an additional layer of filtration, ensuring maximum debris capture during well bore cleaning operations.

Fluid and Debris Management

Further, as shown in FIG. 1, the valve housing (108) creates a controlled pathway for both drilling fluid and debris, ensuring that the fluid flow and debris are managed efficiently. An additional valve may also be provided which may be designed for targeted flow control and enhanced debris management. Further, during the run-in hole (RIH), the Ball seat (114) is configured to let the drilling fluid move upward through this flow bath or pathway.

During RIH, the well mender (100) features a lower junk basket (130) specifically designed to collect and contain larger debris pieces and pieces of rubber. This basket may handle high flow rates, ensuring maximum debris collection without impeding fluid flow.

A float ball valve operates bidirectionally during RIH. This allows smaller particles to flow upward and, during POOH, traps these particles, preventing them from re-entering the wellbore. During the phase when the multi-function tool is being run into the well, the float ball valve allows smaller particles to flow upward. This ensures that while the well mender (100) is descending into the wellbore, any minor debris or particles that are encountered are not trapped but rather allowed to move upward, away from the tool.

Conversely, during the phase when the multi-function tool is being removed from the well (referred to as "pull out of hole" or POOH), the function of the float ball valve shifts. It works to close or trap the particles inside, ensuring that the debris does not re-enter the wellbore. Essentially, during the extraction or pull-out stage, the valve ensures that the captured debris remains confined and is extracted out of the well along with the tool.

The bidirectional functionality of the float ball valve is crucial for the well mender (100)' efficiency. By permitting upward flow during RIH, it prevents premature clogging or unnecessary debris capture. Then, by securing and trapping debris during POOH, it ensures that the cleaning and recovery operations are effective, with debris being safely removed from the wellbore.

Controlled Flow and Shutdown

One or more lower diverter channels (118) come into play, systematically and efficiently directing the flow of fluids and debris as shown in FIG. 5. These channels ensure that all fluids are processed through the tool without any hindrance. The one or more lower diverter channels (118) aid in the systematic and controlled redirection of fluids and debris, ensuring optimal cleaning efficiency. The one or more lower diverter channels (118) in the well bore clean-out apparatus (100) serve to guide and control the flow of fluids and debris. Their main function is to optimize the direction of these materials within the well bore, ensuring efficient cleaning and preventing unwanted accumulation or blockage. Essentially, they act as pathways or conduits, systematically channeling fluids and captured debris to designated areas or components within the well mender (100). These channels provide a predefined path for the fluids and debris, reducing turbulent flow and ensuring a smoother and more directed movement.

By systematically guiding the debris, they prevent accumulation in undesired locations, which could cause blockages or reduced efficiency in the well mender (100). Enhanced Cleaning Efficiency: The strategic positioning and design of the channels ensure that debris is funneled towards filtration or collection components, such as filter sleeve (106) or junk baskets, maximizing the cleaning potential of the well mender (100). By diverting debris and fluids away from sensitive or critical parts of the well mender (100), these channels protect other components from premature wear or potential damage.

At specific stages of operation, a shut off ball (1140) may be activated to block fluid flow entirely. This gives operators the flexibility to manage fluid flow based on operational needs. the shut off ball (1140) may be adapted to engage or disengage based on operational needs, providing flexibility in fluid management within the well bore. The shut off ball (1140), when engaged, may offer a complete blockage of fluid flow, allowing for stages of operation where fluid movement is undesired.

Further, while POOH, the tool being a filter in a downhole environment, configured to capture and filter out unwanted debris from the well fluids as the tool is being removed from the wellbore. The diverter cup (104) is configured to divert fluid while pull out of the hole (POOH) into the filter sleeve (106 to make sure no debris left in the hole before running completion. Furthermore, during pull out of hole (POOH), a ball (1140) of the Ball seat (114) is adapted to position in the Ball seat (114) and shut off or block the flow bath thereby trapping the debris inside.

The shut off ball is a component that may be moved or positioned in such a way that it either allows fluid flow or completely blocks it. Essentially, it acts as a barrier or a stopper within the flow path or channel (1144) of the well mender (100).

The primary function of the shut off ball is to provide on-demand control of fluid flow within the well mender (100). When it's engaged or positioned in its blocking position, it creates a complete seal, stopping fluid flow. Conversely, when it's disengaged or moved away from its sealing position, fluid may flow freely.

Different stages of the well bore operation may require different fluid management strategies. There could be stages where fluid flow must be stopped temporarily—for example, to hold or capture a certain amount of debris, to create a pressure differential, or during certain maintenance or adjustment procedures. The shut off ball (1140) may offer the flexibility to make these operational changes quickly.

By having the capability to shut off fluid flow, the well mender (100) may better manage scenarios where unexpected surges or influxes of fluids occur. Blocking fluid flow may help in managing wellbore pressure and may be vital for preventing unwanted materials or gases from moving within the tool. The shut off ball (1140), when engaged, may trap debris effectively, especially during the "pull out of hole" (POOH) stage. This ensures that the cleaned and captured debris does not re-enter the wellbore.

The shut off ball's (1140) function is complemented by other components in the well mender (100). For instance, the diverter cup (104), filter sleeves (106), and valve housing (108) all work in tandem with the shut off ball to optimize fluid and debris management. The shut off ball (1140) in the well bore clean-out apparatus (100) serves as a critical control mechanism. Its ability to block fluid flow at desired operational stages provides both operational flexibility and enhances the overall efficiency and safety of well bore cleaning and recovery operations.

Stabilization and Safety

The well mender (100) is kept stable and secured within the wellbore using an internal lock key (112). This key ensures that the tool doesn't shift or move unnecessarily during operations, enhancing its performance efficiency. The lower lock key (112) provides a secure fit of the tool within the well bore, minimizing tool movement during operations.

A built-in safety feature, the rupture disk (102), is calibrated to respond to unexpected pressure fluctuations. If the differential pressure exceeds may be, but not limited to, 90 to 110 psi, the disk ruptures, acting as an emergency pressure release mechanism. The rupture disk (102) serves as a safety feature, preventing potential damages due to unexpected pressure build-ups by providing a controlled release mechanism. This feature protects the tool and the well from potential damages due to unexpected pressure build-ups.

On-Site Disassembly and Maintenance

Post-operation, the multi-function tool's design allows for easy on-site disassembly. This is crucial for quickly recovering junk, inspecting the tool for any damages, and performing routine maintenance. Specialized equipment isn't necessary, ensuring rapid turnaround times between operations.

Versatility and Integration

The multi-function tool may be configured for integration into both drilling and non-drilling assemblies. This means it may be used in varied well bore operations, from drilling to cleaning, showcasing its adaptability.

Validation: In accordance with an embodiment of the present invention, the configuration of filter sleeve (106) may be used to validate the well's readiness for production. The filter sleeve (106) may be configured to validate the well's suitability for production by trapping debris exceeding a predetermined size. By assessing the trapped debris and its quantity, operators may determine if the well is clean enough for production operations.

In simpler terms, the method of operation for the well mender (100) is delineated through sequential phases: Initialization & Run-in-hole Phase, Filtering & Diverting Process, Safety Mechanism Activation, Pull-out-of-hole Phase & Debris Retention, Final Retrieval & Cleaning, and Lock & Secure.

During the Initialization & Run-in-hole Phase, the Multi-Function Filter Tool (apparatus (100)) is attached to the drilling assembly and is subsequently lowered into the wellbore. As the tool makes its descent, fluids accompanied by smaller debris particles are allowed to pass through the Ball seat (114). In this phase, the Ball seat (114) remains open, facilitating an unrestricted upward flow. Concurrently, the Lower filter sleeve (110), Debris Basket, specifically configured to capture larger debris, begins its collection process, ensuring there are minimal hindrances for the upcoming operations.

During the Filtering & Diverting Process, as drilling advances and fluid circulates, the Diverter Cup, constructed from materials proficient in directing flow, such as rubber or silicone, steers the drilling fluids towards the Filter sleeve (106). The Filter sleeve (106), punctuated with precise perforations, permits fluid to flow through while capturing debris exceeding its hole dimensions. This process guarantees the purity of the well, subsequently minimizing potential issues in the completion phase.

During the Safety Mechanism Activation phase, if a pressure differential surpassing the Rupture Disk's designated threshold is detected, often around 90-110 psi, the disk, crafted from materials like stainless steel or elastomer, is prompted to rupture. This vital action ensures the internal pressure is harmonized, thereby protecting both the tool and the wellbore from potential adversities.

In the Pull-out-of-hole Phase & Debris Retention, as the tool undergoes extraction, a ball finds its position on the Ball seat (114), leading to the closure of the flow path (1144). This setup is pivotal in guaranteeing that all debris secured within the well mender (100) stays contained. Augmenting this debris retention action is the distinct one-way valve housing & shut off ball, typically constructed from materials like brass or stainless steel. This feature not only allows debris to enter but crucially prevents its exit, amplifying the tool's overall cleaning efficacy.

Once the well mender (100) is fully retrieved from the wellbore, it is configured for straightforward disassembly. The lower junk basket or lower junk collector (130), particularly tailored to ensnare bigger debris fragments, is readily accessible for cleaning. This meticulous cleaning process guarantees that prior to its next use, the well mender (100) is devoid of any impediments, primed for optimal performance. On another note, the lock key (112), strategically situated at the bottom of the tool, serves as the anchoring well mender throughout its operational stages. Such a mechanism bolsters the tool's steadiness, right from the drilling stages up to its eventual retrieval.

Issue with junk collection in traditional systems is that traditional systems are designed to operate primarily during the "run in hole" phase, where they intake or "swallow" larger debris. However, this mechanism only captures the junk as the tool is being inserted into the well. As a result, any large debris encountered after this phase remains unaddressed, potentially causing obstructions or inefficiencies.

Further, traditional systems are tailored to capture only larger debris. While this may be effective for bigger particles, smaller particles are often left behind. These smaller remnants settle at the bottom of the well and can't be easily circulated out. Over time, these remnants may compromise the well's completion process, potentially leading to decreased productivity and increased operational challenges. Another limitation of traditional systems is their lack of adaptability for on-field inspections. Unlike the new system, traditional tools don't easily open up on-site to inspect and remove the collected junk. This restricts operators from checking the retrieved debris before deciding to re-insert (re-run) the tool into the well. This lack of insight may lead to repeated runs or overlooked obstructions.

Traditional systems lack a specially designed cup at the top, which is instrumental in guiding or "diverting" fluids into a filter sleeve (106). Without this feature, traditional tools miss out on the added advantage of acting as a downhole filter, potentially leaving behind more contaminants and affecting the overall cleanliness of the wellbore. Furthermore, traditional systems are not equipped with a one-way valve mechanism. Such a valve is crucial for ensuring that once debris is captured, it remains securely inside the tool, especially during the "pull out of hole" (POOH) phase. Without this feature, there's a risk of previously trapped junk being released back into the well during retrieval, negating some of the cleaning efforts.

In summary, while traditional wellbore cleaning systems have been instrumental in addressing certain challenges, they exhibit several limitations. These include a restricted debris capture scope, inability to efficiently handle smaller particles, lack of on-site inspection capabilities, and the absence of features ensuring comprehensive fluid diversion and debris containment. The new system addresses these gaps, offering a more holistic and efficient solution for wellbore cleaning operations.

The present invention provides various advantages over prior arts such as, but not limited to:

1. Enhanced Downhole Filtration: Unlike the traditional systems, the updated downhole filter is fitted with a diverter cup (104). This specialized cup is instrumental when pulling out of the hole (POOH) as it strategically directs the fluid flow into the filter sleeve (106). This optimized flow diversion ensures that any lingering debris is effectively captured, leaving the wellbore cleaner and more primed for subsequent completion processes.
2. Innovative Float Ball Valve Mechanism: A significant improvement over traditional designs is the introduction of a uniquely designed float ball valve in the new product. This valve is adept at functioning in both directions. When running into the hole, it permits smaller particles to ascend, ensuring a cleaner descent. Conversely, during the pull-out phase, it acts to seal off any bypass routes, efficiently trapping the debris within the tool. This dual-action ensures a more thorough and efficient cleaning process compared to older methods that might allow debris to escape or not be effectively trapped.

3. Optimized Junk Basket Design: The newly designed lower junk basket (130) is an evolution over traditional systems. It's crafted to intake and secure large debris particles effectively during the run-in-hole phase. An added advantage is its capability to accommodate high flow rates, ensuring that the cleaning process is both swift and efficient, minimizing operational delays often experienced with traditional tools.
4. Comprehensive Particle Filtration with the Extended Filter sleeve (106): Another salient feature of the new design is the elongated filter sleeve (106), which offers enhanced filtration capabilities. This jacket is meticulously designed to trap smaller particles, specifically those exceeding 1 MM in size. This precision ensures that even minuscule contaminants, which traditional systems might overlook, are effectively captured, ensuring a purer and debris-free wellbore environment.

In essence, when juxtaposed with traditional methodologies, the new system showcases several advancements. From tailored fluid diversion mechanisms and dynamic valve designs to optimized junk collection and precision filtration, it offers a comprehensive and more efficient solution to wellbore cleaning challenges previously unaddressed by conventional tools.

5. Optimized Cleaning and Fewer Runs: The new system may be configured to optimize the number of runs required to clean the well bore, potentially saving time and resources.
6. Versatility: The multi-function tool may be used both in drilling and non-drilling applications, offering flexibility and potentially reducing the need for multiple specialized tools.
7. Effective Debris Recovery: The system effectively recovers large junk and rubber, ensuring a cleaner well bore.
8. Downhole Filtering: The tool acts as a downhole filter during retrieval, further enhancing the cleaning capability by trapping debris.
9. Emergency Pressure Release: The inclusion of a rupture disk (102) configured to act at a differential pressure of 90 to 110 psi adds a safety feature, providing an emergency pressure release mechanism to avoid well damage and other hazardous situations.
10. Enhanced Sealing: The diverter cup (104) with a rubber element provides improved sealing between the casing and the tool body, ensuring that fluids are effectively diverted and no debris passes around the tool.
11. Selective Flow Control: The Ball seat's (114) unique design provides controlled flow when running in the hole and shuts off flow when pulling out, effectively trapping debris.
12. Enhanced Debris Filtration: The filter sleeve (106 may be configured with specific hole sizes to trap debris of certain sizes, ensuring a cleaner output and better well validation for production.
13. Improved Connection Integrity: The valve housing's (108) main mandril (210) may be configured as a single piece with a 4½ in box connection with an integral groove, which might offer stronger and more reliable connections.
14. Easy On-site Maintenance: The design allows for easy on-site disassembly, facilitating junk recovery and tool maintenance without the need for specialized off-site facilities or equipment.
15. Better Handling of Horizontal Wells: Traditional systems had challenges with horizontal wells where small particles settled on the low side and couldn't be circulated out. The new design appears to address this limitation, potentially providing a more comprehensive cleaning solution for horizontal well applications.
16. Secure Positioning: The lower lock key (112) ensures the tool is securely positioned within the wellbore, reducing unwanted movements and improving operational efficiency.

Various modifications to these embodiments are apparent to those skilled in the art from the description and the accompanying drawings. The principles associated with the various embodiments described herein may be applied to other embodiments. Therefore, the description is not intended to be limited to the embodiments shown along with the accompanying drawings but is to be providing broadest scope of consistent with the principles and the novel and inventive features disclosed or suggested herein. Accordingly, the invention is anticipated to hold on to all other such alternatives, modifications, and variations that fall within the scope of the present invention and the appended claims.

The invention claimed is:

1. A well mender, which is a multi-function tool configured for optimizing cleaning and recovery operations within a well bore, and configured for performing run in hole (RIH) and pull out of the hole (POOH), wherein the well mender comprises:

a diverter cup comprising a rubber element configured to direct fluid flow and to serve as a seal interface between a casing and a tool body;

a filter sleeve with predetermined hole sizes configured for filtering out debris of specified sizes;

a valve housing providing a controlled pathway configured for drilling fluid and debris;

a valve configured for targeted flow control and debris management, wherein the valve is positioned below the filter sleeve;

a shut off ball configured to block fluid flow at desired stages of operation;

a lower filter sleeve positioned below the filter sleeve and below the valve, the lower filter sleeve being configured for additional debris capture;

one or more lower diverter channels configured to facilitate controlled flow and direction of fluids and debris, wherein all parts of the one or more lower diverter channels are positioned below the filter sleeve;

an internal lock key configured for securing and stabilizing the well mender within a well bore; and a rupture disk configured to rupture upon a predetermined differential pressure, providing an emergency pressure release mechanism.

2. The well mender as claimed in claim 1, further comprising a means for facilitating on-site disassembly for junk recovery, inspection, and well mender maintenance.

3. The well mender as claimed in claim 1, wherein the well mender is configured to, when being run into the well (referred to as "run in hole"), recover (or collect) large debris as well as pieces of rubber using the lower filter sleeve or a lower junk collector.

4. The well mender as claimed in claim 1, wherein the well mender is configured to be a filter in a downhole environment, and the well mender is configured to capture and filter out unwanted debris from the well fluids as the well mender is being removed from the wellbore.

5. The well mender as claimed in claim 1, wherein the diverter cup is configured to divert fluid, during pull out of the hole (POOH), into the filter sleeve to reduce debris left in the hole before a running completion.

6. The well mender as claimed in claim 1, further comprising a float ball valve configured to work in both directions during run in hole (RIH), configured to allow particles to flow upward, configured to pull out of the hole, and configured to close to trap debris inside.

7. The well mender as claimed in claim 1, further comprising a lower junk basket configured to swallow large size of junk during run in hole (RIH) and configured to allow high flow rate.

8. The well mender as claimed in claim 1, comprising a long filter sleeve configured to collect small particles larger than 1 MM to be trapped inside.

9. The well mender as claimed in claim 1, comprising a Ball seat and flow path, wherein the Ball seat is configured to, during the run-in hole (RIH), let the drilling fluid move upward through this flow path or pathway, and wherein, during pull out of hole (POOH), a ball of the Ball seat is adapted to position in the Ball seat and shut off or block the flow path thereby trapping the debris inside.

10. The well mender as claimed in claim 1, wherein the well mender is adapted to be integrated as a part of both drilling and non-drilling assemblies, for enhancing the versatility of the well mender for varied well bore operations.

11. The well mender as claimed in claim 1, wherein the diverter cup's rubber element is further configured to ensure a leak-proof seal, and to prevent fluid bypass around the well mender during operational stages.

12. The well mender as claimed in claim 1, wherein the filter sleeve is configured to validate the well's suitability for production by trapping debris exceeding a predetermined size.

13. The well mender as claimed in claim 1, wherein the valve provides flow control capabilities for enhancing the well mender's debris management.

14. The well mender as claimed in claim 1, wherein the shut off ball is adapted to engage or disengage based on operational needs, for providing flexibility in fluid management within the well bore.

15. The well mender as claimed in claim 1, wherein the lower filter sleeve offers an additional layer of filtration, for assisting maximum debris capture during well bore cleaning operations.

16. The well mender as claimed in claim 1, wherein the one or more lower diverter channels are configured to aid in the systematic and controlled redirection of fluids and debris, for assisting optimal cleaning.

17. The well mender as claimed in claim 1, wherein the lower lock key is configured to provide a secure fit of the well mender within the well bore, for reducing well mender movement during operations.

18. The well mender as claimed in claim 1, wherein the rupture disk is configured to serve as a safety feature, and is configured to reduce potential damages due to unexpected pressure build-ups by providing a controlled release mechanism.

19. The well mender as claimed in claim 1, wherein the rupture disk is specifically calibrated to rupture upon experiencing a differential pressure of the order 90 to 110 psi, for assisting a response to pressure fluctuations.

20. The well mender as claimed in claim 1, wherein the valve housing includes a main mandrel designed as a single piece, comprising a 4½ in BOX connection with an integral groove, for optimizing the connection strength and integrity.

21. The well mender as claimed in claim 1, wherein the filter sleeve comprises hole sizes of 3 MM, for trapping debris exceeding this size and for enhancing quality of the filtered output.

22. The well mender as claimed in claim 1, wherein the diverter cup's rubber element is tailored to fit securely within the casing internal diameter (ID) for further enhancing its sealing and fluid diversion capabilities during POOH.

23. The well mender as claimed in claim 1, wherein the shut off ball, when engaged, offers a complete blockage of fluid flow, for allowing for stages of operation where fluid movement is undesired.

24. The well mender as claimed in claim 1, wherein the well mender's design incorporates features facilitating onsite disassembly, enabling rapid junk recovery and well mender maintenance without the need for specialized equipment.

25. The well mender as claimed in claim 1, wherein the casing refers to a tubular steel structure that is placed in a drilled well to stabilize the wellbore and inhibit the surrounding rock formation from collapsing.

* * * * *